US006557831B2

(12) United States Patent
Erwin

(10) Patent No.: US 6,557,831 B2
(45) Date of Patent: May 6, 2003

(54) FENCE BRACKET

(75) Inventor: Ronald D. Erwin, Fayetteville, GA (US)

(73) Assignee: Erwin Industries, Inc., Peachtree City, GA (US)

( * ) Notice: Subject to any disclaimer, the term of this patent is extended or adjusted under 35 U.S.C. 154(b) by 0 days.

(21) Appl. No.: 09/928,324

(22) Filed: Aug. 13, 2001

(65) Prior Publication Data

US 2002/0121635 A1 Sep. 5, 2002

Related U.S. Application Data

(63) Continuation-in-part of application No. 09/859,013, filed on May 15, 2001.

(60) Provisional application No. 60/273,508, filed on Mar. 5, 2001, and provisional application No. 60/273,375, filed on Mar. 5, 2001.

(51) Int. Cl.[7] ..... E04H 17/00

(52) U.S. Cl. ..... 256/65.04; 256/65.03; 256/65.06; 52/698; 248/314

(58) Field of Search ..... 256/65.03, 65.04, 256/65.05, 65.06, 19; 52/698, 704, 770; 248/247, 250, 314

(56) References Cited

U.S. PATENT DOCUMENTS

| | | | | |
|---|---|---|---|---|
| 2,608,386 A | | 8/1952 | Hart | |
| 2,666,238 A | | 1/1954 | Hagedorn | |
| 3,134,566 A | | 5/1964 | Beene, III | |
| 3,136,530 A | * | 6/1964 | Case | 256/24 |
| 3,615,110 A | | 10/1971 | Fugate | |
| 4,114,861 A | | 9/1978 | Long | |
| 4,226,393 A | | 10/1980 | Rardin et al. | |
| 4,272,060 A | | 6/1981 | Stafford | |
| 4,280,686 A | | 7/1981 | Wack | |
| 4,667,935 A | | 5/1987 | Moore | |
| 5,029,820 A | | 7/1991 | Katz | |
| 5,100,107 A | * | 3/1992 | Latta | 256/19 |
| 5,121,891 A | | 6/1992 | Goldsmith | |
| 5,186,571 A | | 2/1993 | Hentzschel | |
| 5,215,290 A | | 6/1993 | Khalessi | |
| 5,238,321 A | | 8/1993 | Jarjoura | |
| D368,850 S | | 4/1996 | Coppedge et al. | |
| 5,547,169 A | | 8/1996 | Russell | |
| 5,603,580 A | | 2/1997 | Leek et al. | |
| 5,645,270 A | | 7/1997 | Lawrence | |
| 5,702,090 A | | 12/1997 | Edgeman | |
| 5,755,431 A | | 5/1998 | Williams | |
| 5,788,224 A | | 8/1998 | Platt | |
| 5,873,671 A | | 2/1999 | West | |
| 5,938,184 A | * | 8/1999 | DeSouza | 256/19 |
| 5,967,498 A | * | 10/1999 | Junell | 256/19 |

(List continued on next page.)

FOREIGN PATENT DOCUMENTS

| | | |
|---|---|---|
| GB | 20230 | 11/1899 |
| GB | 435226 | 9/1935 |

*Primary Examiner*—Anthony Knight
*Assistant Examiner*—Lisa Bannapradist
(74) *Attorney, Agent, or Firm*—Gardner Groff, P.C.

(57) ABSTRACT

A fence mounting bracket for use with a fence, railing, or the like having upright posts, lateral rails extending between the posts, and upright picket boards extending between the rails. The bracket comprises a body having a peripheral wall defining a T-shaped opening including a rail opening portion for receiving an end of one of the rails and two picket opening portions for receiving an edge of one of the picket boards. The peripheral wall has opposing side walls that are slanted and/or inwardly flanged to receive the rails when they are positioned either horizontally or at an angle to horizontal. The picket opening portions extend through the side walls to permit the picket boards to seat flush against the upright posts so that little or nor gap remains therebetween.

14 Claims, 6 Drawing Sheets

U.S. PATENT DOCUMENTS

| | | | | | |
|---|---|---|---|---|---|
| 6,017,019 | A | * | 1/2000 | Erwin | 256/65.05 |
| 6,053,481 | A | | 4/2000 | Scheide | |
| D435,213 | S | | 12/2000 | Erwin | |
| D436,836 | S | | 1/2001 | Erwin | |
| 6,173,944 | B1 | | 1/2001 | McCarthy | |
| D437,772 | S | | 2/2001 | Erwin | |
| 6,260,828 | B1 | * | 7/2001 | English | 256/24 |
| 6,345,809 | B1 | | 2/2002 | Bebendorf | |
| 2002/0011594 | A1 | * | 1/2002 | DeSouza | 256/19 |

* cited by examiner

FENCE BRACKET

CROSS REFERENCE TO RELATED APPLICATIONS

This application claims the priority benefit of U.S. Provisional Application No. 60/273,508, filed Mar. 5, 2001, U.S. Provisional Application No. 60/273,375 filed Mar. 5, 2001, and is a continuation-in-part of U.S. patent application Ser. No. 09/859,013, filed May 15, 2001, all of which are hereby incorporated by reference in their entirety.

TECHNICAL FIELD

The present invention relates generally to railing and fencing and, more specifically, to a mounting bracket for a railing or fence.

BACKGROUND OF THE INVENTION

Outdoor decks are extremely popular in residential home construction. Homes and apartments, as well as a variety of other buildings, often incorporate exterior decks into their design. These decks provide convenient spaces for a variety of outdoor activities, including cookouts, dining and sunbathing, as well as other leisure activities. Moreover, decks typically are provided with a railing or perimeter fence to keep people from falling over the edge of the deck. Additionally, perimeter and accent fencing is commonly added onto landscapes, creating a boundary for foliage displays and garden areas.

Wood products traditionally have been the primary source of materials for use in decking and fence construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long-lasting substitute construction materials that can lessen the need to harvest timber resources.

One potential approach to addressing the above need is to provide substitute fence and decking products made of plastic, rather than wood. Plastic fence products provide a long-lasting alternative to wood. In addition, plastic fence products alleviate the need for costly painting and repainting. A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits. Such plastic material can be used to create fencing elements.

Plastic fences tend to be relatively inexpensive and durable, but often present difficulties in attaching a rail thereof to an upright post thereof. Conventional wood or metal fence rails can be attached to the fence posts by welding, nails, screws, bolts, and so forth, but these techniques are not suitable for plastic fence rails and posts. A number of different brackets have been designed for attaching plastic fence rails to the upright posts. However, such known brackets are designed for use with the fence rails and posts in specific positions only and are thus limited in their applications. Also, known brackets are not entirely suitable for use with "shadow box" fencing (a type of privacy fence having relatively wide picket boards and in which adjacent picket boards are staggered front and back) because the width of the bracket creates a gap between the fence post and the end picket board adjacent the post.

Accordingly, a need yet remains in the art for a mounting bracket that can be used in plastic or wood fencing or railing to mount rails to upright posts, that is adaptable in that it can be used to configure the rails in a variety of different positions, and that is inexpensive, lightweight, and weather-resistant. It is to the provision of such a bracket that the present invention is primarily directed.

SUMMARY OF THE INVENTION

The present invention both overcomes the above-mentioned disadvantages of the prior art and meets the recognized need for such a device by providing a unique bracket for use in a fence system having upright posts, rails extending laterally between the posts, and upright picket boards extending between the rails. The bracket can be attached to one of the posts and can secure one of the rails to the post and/or one of the pickets in a position closely adjacent to the post. It will be understood that the bracket can be suitably utilized with other fence systems such as railings or the like.

Generally described, the bracket comprises a body made of plastic or another material. The body has a base and a peripheral wall extending from the base, with the peripheral wall having a distal portion spaced apart from the base. For use with rectangular rails and pickets, the peripheral wall includes two opposing side walls and two opposing end walls. The peripheral wall defines an opening that is wider at the distal portion than at the base. The base has attachment ears or is otherwise adapted for mounting the bracket body to one of the posts.

In one aspect of the invention, the opening includes a rail opening portion that can receive an end of one of the rails. The opposing side walls are slanted towards each other so that the rail opening portion is generally trapezoidal when viewed from the side. Additionally or alternatively, the distal portion includes an inward flange that defines the rail opening portion. In this way, the rail end can be received in the rail opening portion when the rail is positioned generally perpendicularly to the post (when the fence is installed on generally horizontal ground) or at another angle (when the fence is installed on ground that is not level).

In another aspect of the invention, the opening includes at least one and preferably two picket opening portions that extend through the opposing side walls. The picket opening portions are connected to the rail opening portion so that the opening is generally T-shaped. In this way, an edge of one of the pickets can be received in the picket opening portions and allowed to extend through the side wall so that little or no visible gap is formed between the picket and the post.

These objects, advantages, and features of the present invention will become more apparent upon reading the following specification in conjunction with the accompanying drawing figures.

BRIEF DESCRIPTION OF THE DRAWING FIGURES

The present invention will be better understood by reading the Detailed Description of the Exemplary Embodiment with reference to the accompanying drawing figures, in which.

DETAILED DESCRIPTION OF THE EXEMPLARY EMBODIMENTS

In describing the exemplary embodiments of the present invention, specific terminology is employed for the sake of clarity. The invention, however, is not intended to be limited to the specific terminology so selected. Also, it will be understood that terms used in the singular form herein are intended to also include the plural form, and terms used in the plural form herein are also intended to include the singular form.

Figure 1:
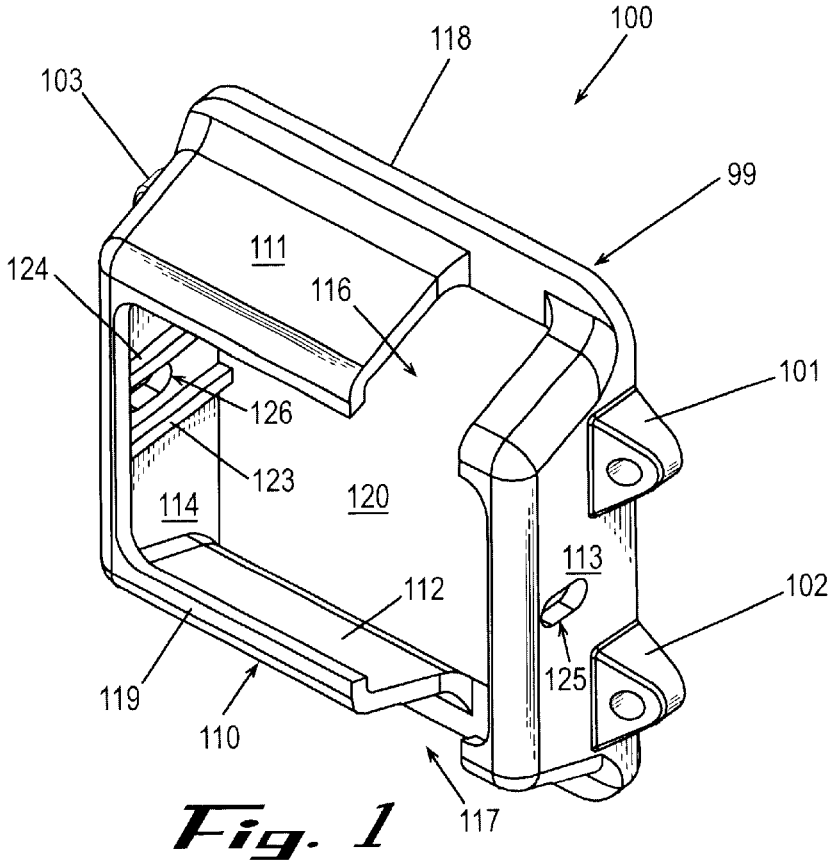
FIG. 1 is a perspective view of a fence bracket according to an exemplary form of the invention.
Figure 2:
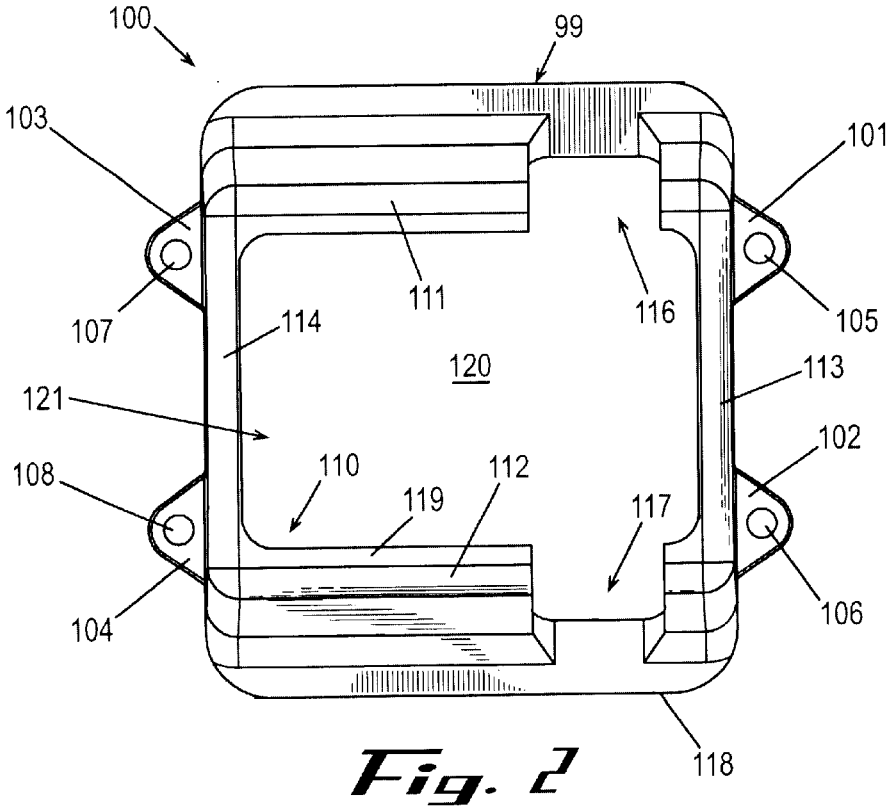
FIG. 2 is a front elevation view of the fence bracket of FIG. 1.
Figure 8:
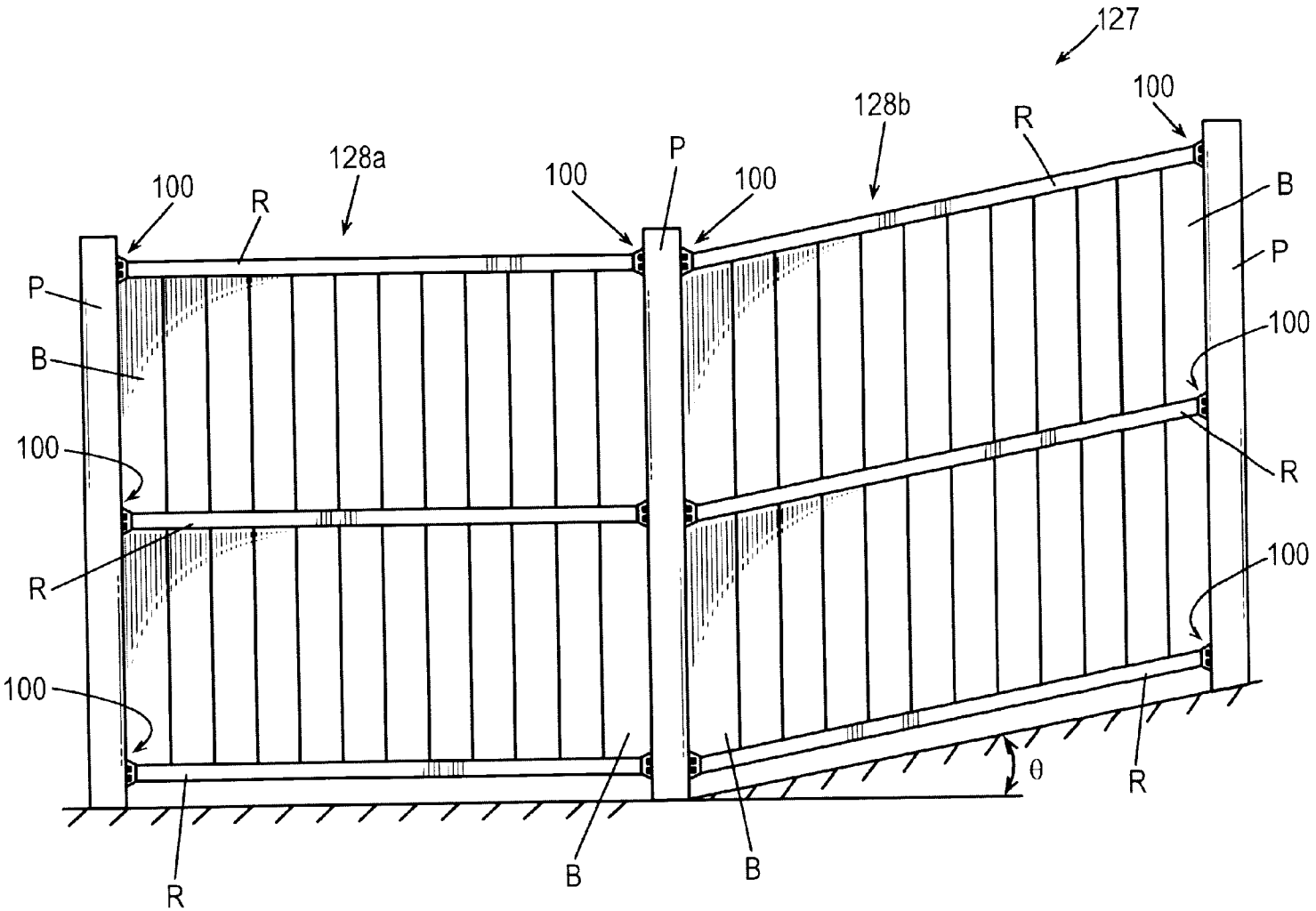
FIG. 8 is a side elevation view of a shadow box fence system including a plurality of the fence brackets of FIG. 1, showing a first fence section on horizontal ground and a second fence section on ground angled from horizontal.

Referring now in detail to the drawing figures, wherein like reference numerals represent like parts throughout the several views, FIGS. 1 and 2 show a fence mounting bracket 100 according to an exemplary form of the invention. The bracket 100 is used in a fence system having upright posts, lateral rails extending between the posts, and upright picket boards extending between the rails, with the bracket attached to the posts and supporting the rails. Such an exemplary fence system is shown in FIG. 8 and described in more detail below. As used herein, the term "fence" means conventional fences for yards, gardens, shrubbery, equipment, and so forth, railings for decks, walkways, stairways, and so forth, and other similar structures known in the art, whether made of plastic, wood, metal, fiberglass, composites, or another material.

The bracket 100 has a body 99 that is made of a plastic such as PVC. Alternatively, the body 99 can be made of metal, wood, fiberglass, another plastic, a composite, or another material. The bracket body 99 can be made by injection molding or another fabrication technique known in the art. The bracket body 99 preferably has a generally square overall footprint, though alternatively it can have another regular or irregular shape, such as a T-shape to generally conform to the shape of the bracket opening described below.

Preferably, four attachment ears 101–104 extend outwardly from the bracket body 99 (for example, from the base described below). The attachment ears 101–104 have holes 105–108 formed therein for receiving screws (or other fasteners such as bolts, rivets, pins, or the like) for securing the bracket 100 to one of the upright posts of the fence system. Alternatively, the holes 105–108 can be provided in the body 99 of the bracket. Of course, the bracket 100 can be attached to one of the posts by an adhesive and/or other conventional fastening structures can be used.

The bracket body 99 includes a peripheral wall 110 preferably arranged in a rectangular fashion to make the bracket 100 rather box-like. Alternatively, the peripheral wall 110 can be arranged in a circular, polygonal, or other regular of irregular fashion for use with a rail having a similar cross-sectional shape. In the rectangular configuration, the peripheral wall 110 includes first and second opposed side walls 111 and 112 and first and second opposed end walls 113 and 114.

The end walls 113 and 114 of the peripheral wall 110 have fastener holes 125 and 126 defined therein that are preferably elongate for receiving screws (or other fasteners) for securing the rail and/or picket, as the case may be, within the bracket opening 120. To strengthen the end walls 113 and 114 in the vicinity of these fastener holes 125 and 126, bolster rails 123 and 124 (or ribs, corrugations, or other bracing structures) can be provided flanking each of the fastener holes 125 and 126 and extending from the base 118 toward the distal portion 119.

The side walls 111 and 112 are breached by picket opening portions 116 and 117, while end walls 113 and 114 are not so breached. Alternatively, the end walls 113 and 114 can be similarly breached to provide a bracket 100 that is unidirectional, if so desired. The side walls 111 and 112 and end walls 113 and 114 extend from a base member 118 of the body 99 to a distal portion 119. The base member 118 preferably has the form of a peripheral plate (or a solid plate or other base structure), and the distal portion 119 is preferably formed by an inward flange 130 that is spaced apart from the base 118.

Figure 3:
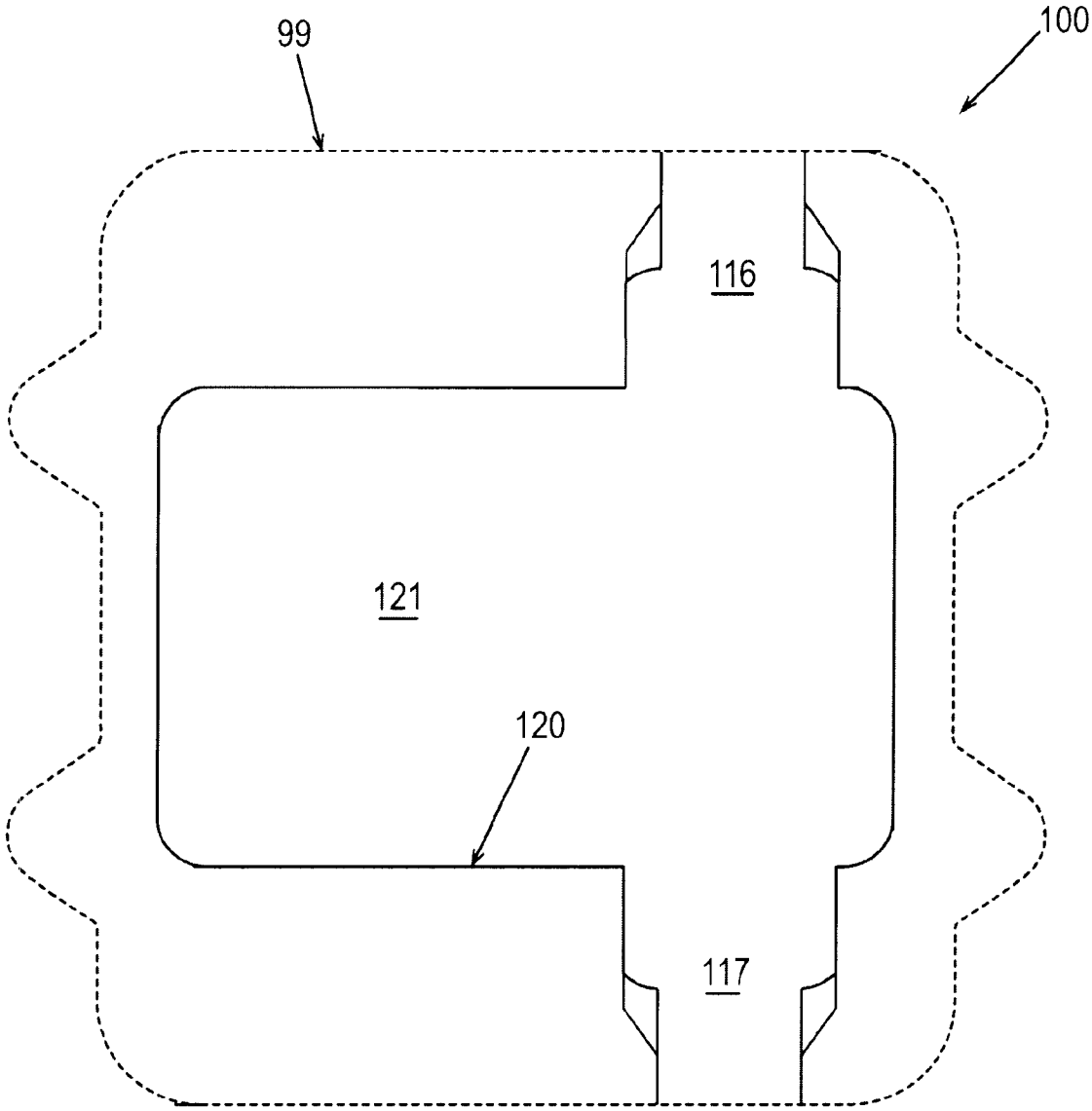
FIG. 3 is a schematic view of the fence bracket of FIG. 2, showing an outline of the fence bracket in dashed lines and a bracket opening defined in the fence bracket in solid lines.

Accordingly, the side walls 111 and 112 and end walls 113 and 114 define a three dimensional bracket opening 120 that includes a rail opening portion 121 in the distal portion 119 that intersects with the picket opening portions 116 and 117 in the side walls 111 and 112. As shown in FIGS. 2 and 3, the rail opening portion 121 and the picket opening portions 116 and 117 are preferably generally rectangular, so that the resulting opening 120 is generally T-shaped. This is best seen in FIG. 3, in which the T-shaped opening 120 is shown in solid lines, while the overall shape of the bracket body 99 is shown in dashed lines. Of course, the rail and picket opening portions can have other regular or irregular shapes, as may be desired in a particular application.

Figure 4:
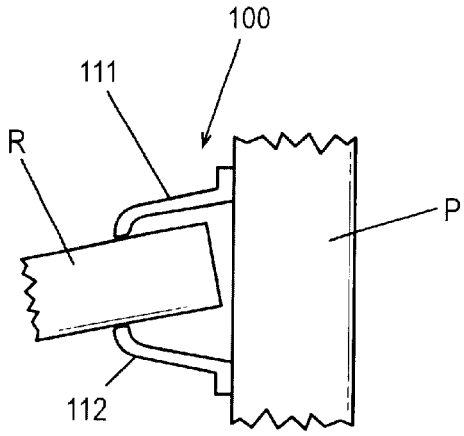
FIG. 4 is a side elevation view of the fence bracket of FIG. 1, showing a fence rail angled from horizontal with its end secured in the bracket opening.

As best seen in FIGS. 1 and 4, the side walls 111 and 112 of the peripheral wall 110 can be slanted towards each other somewhat, with the rail opening portion 121 wider at the base 118 than at the distal portion 119, so that the three dimensional rail opening 121 is generally trapezoidal when viewed from the side. This feature of slanting the side walls 111 and 112 toward each other allows the rail opening 121 to accept the fence rail therein at an angle other than (and including) 90 degrees. This allows, for example, the fence system to follow uneven terrain while still securely receiving the ends of the rails in the brackets 100. Similarly, the end walls 113 and 114 can be slanted toward each other to permit the fence system follow a lateral curvilinear path.

Additionally, due to the preferable presence of the inward flange 130 of the peripheral wall 110, the rail opening 121 is wider at the base than at the flange, for the same purpose. Thus, the slanted and flanged peripheral wall 110 permits the rail opening 121 to receive the end of the fence rail therein when the fence rail is disposed either perpendicularly (when the fence is installed on horizontal ground) or at another angle relative to the posts (when the fence is installed on ground angled from horizontal). In this way, the same fence bracket 100 can be used to erect a fence on ground with most any slope.

Figure 4A:
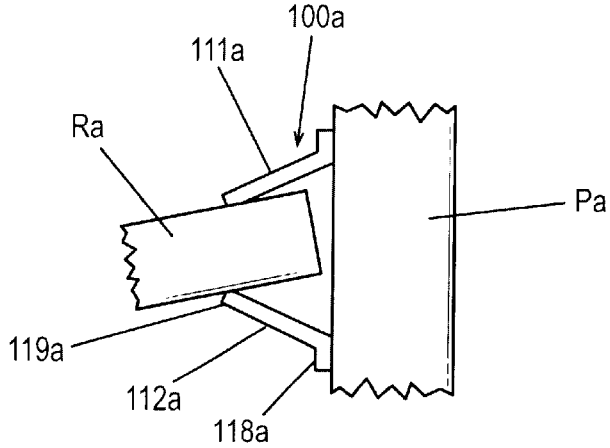
FIG. 4A is a side elevation view of a fence bracket according to a first alternative form, showing a slanted peripheral wall (that is not flanged) in use with an angled fence rail.
Figure 4B:
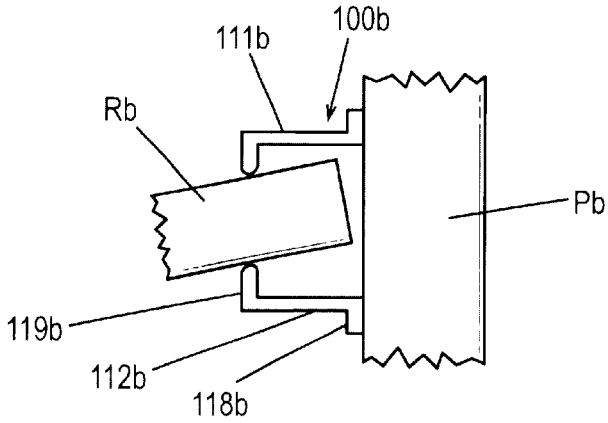
FIG. 4B is a side elevation view of a fence bracket according to a second alternative form, showing a flanged peripheral wall (that is not slanted) in use with an angled fence rail.

FIG. 4A shows a first alternative form of the invention in which the sidewalls 111*a* and 112*a* of the bracket 100*a* are slanted, but are not flanged. FIG. 4B shows a second alternative form of the invention in which the sidewalls 111*a* and 112*a* of the bracket 100*a* are flanged, but are not slanted. In each of these alternative embodiments, rails Ra and Rb can be positioned at various angles because the rail openings 121*a* and 121*b* are wider at the distal portions 119*a* and 119*b* than at the bases 118*a* and 118*b*.

Figure 5:
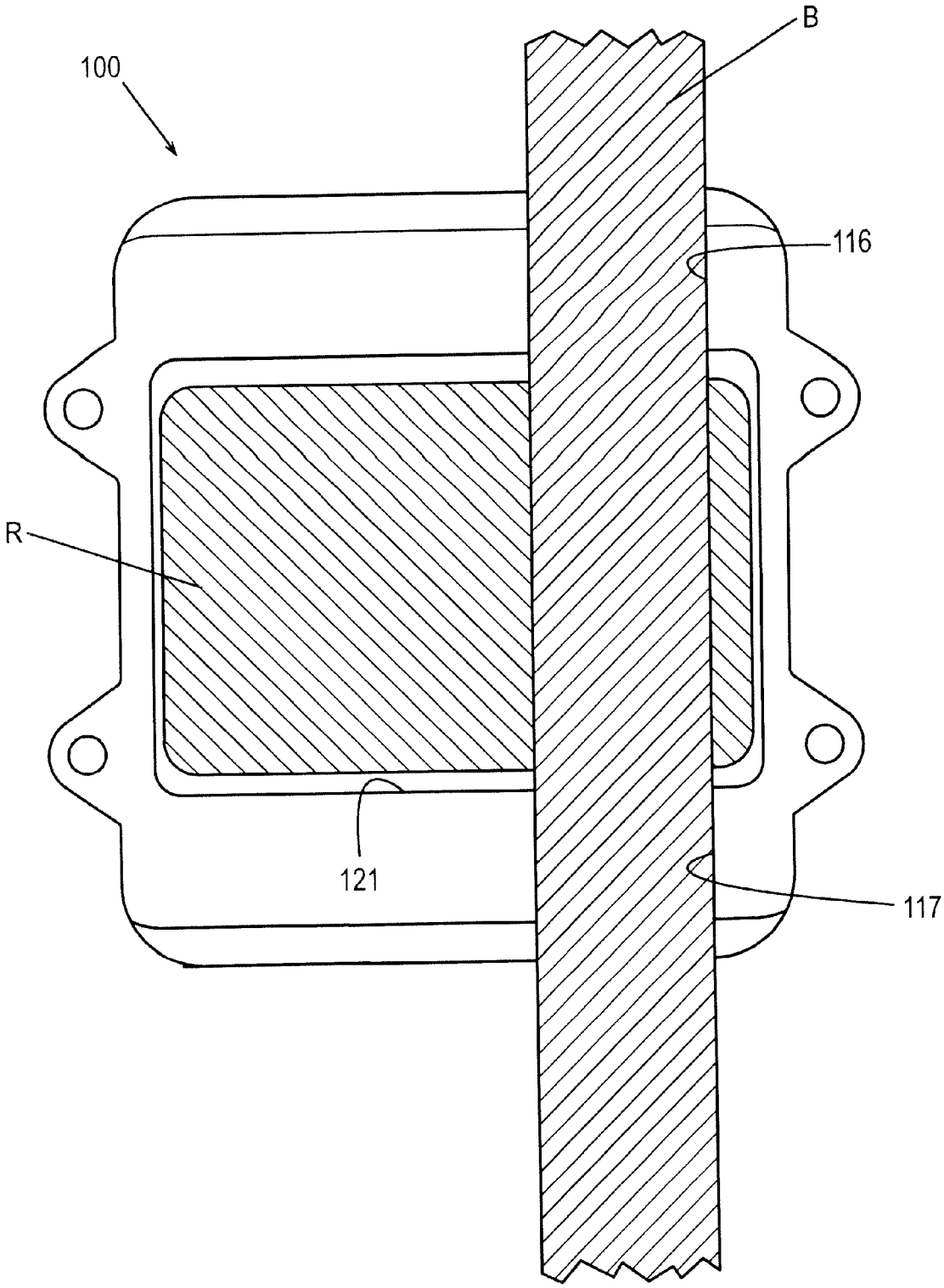
FIG. 5 is a front elevation view of the fence bracket of FIG. 1, showing a fence rail and a picket edge (both shown in section) inserted in the opening.
Figure 6:
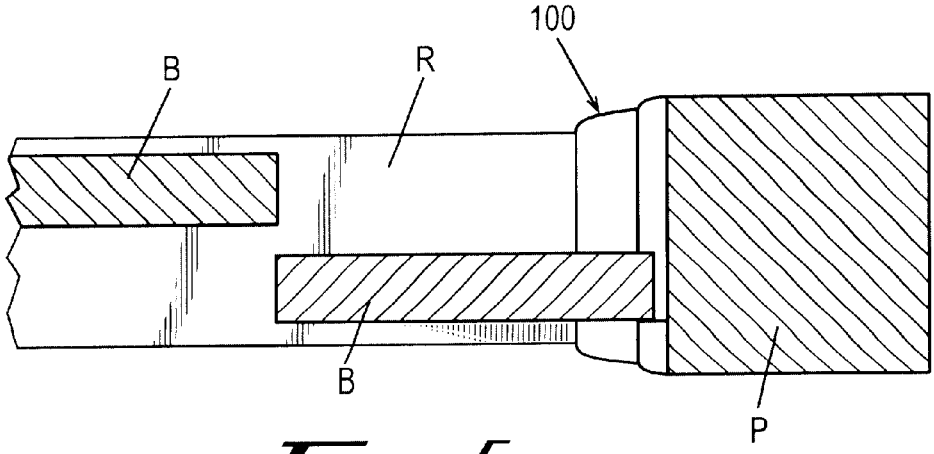
FIG. 6 is a plan view of a portion of a shadow box fence system including the fence bracket of FIG. 1, showing the fence rail and the picket edge inserted in the opening.
Figure 7:
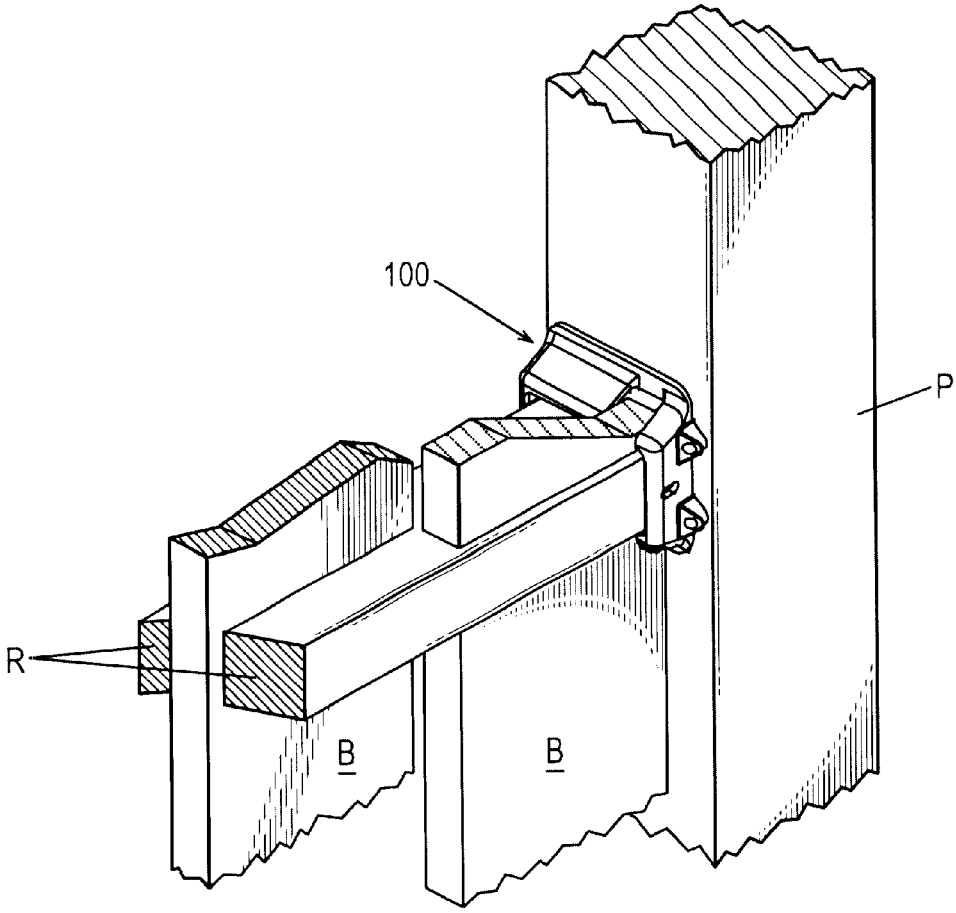
FIG. 7 is a perspective view of the portion of the fence system of FIG. 6.

FIGS. 5–7 show the bracket 100 receiving both an end of a rail R and an edge of a picket board B of the fence system. Note that each rail R has an upright picket board B extending therethrough in the vicinity of the corresponding bracket 100. The picket opening portions 116 and 117 in the side walls accommodate the picket boards B without substantially offsetting the picket board B from the post P. More particularly, the picket opening portions 116 and 117 receive the edge of the end picket board B to allow the picket board to extend through the bracket 100 on opposite sides and come flush against (meaning closely adjacent, but not necessarily touching, so that little or no visible gap remains) the upright fence post P, while the rail R is securely received in the rail opening portion 121. In this way, the tight spacing typically maintained between adjacent intermediate picket boards in the fence (when viewed from the side) also can be maintained between the end picket board and the post. This results in a uniform and aesthetic appearance, and provides privacy and security from those on the other side of the fence.

The bracket 100 is particularly well suited for use with a shadow box fence system 127 as shown in FIG. 8. A typical shadow box fence system 127 includes upright picket boards B extending between lateral rails R that in turn extend laterally between upright posts P. The picket boards B are positioned alternately front and back, so that there is little or no gap between adjacent intermediate picket boards when viewed from the side. A portion of such a shadow box fence system also is shown in FIGS. 6 and 7, and is described in more detail in U.S. patent application Ser. No. 09/859,013. In a typical commercial embodiment, the rails are nominally 2×3 and the picket boards are nominally 1×4, so the rail opening portion can be about twice as wide as the picket opening portions.

FIG. 8 shows how identical brackets 100 can be used for erecting a fence on ground that is not flat, and for illustration purposes depicts adjacent first and second fence sections 128*a* and 128*b* of the shadow box fence system 127. Typically, many of these fence sections are connected together, though only one (or two or any other number) can be used depending on the particular fencing job. The rails R are secured to the posts P using a number of the mounting brackets 100 shown in FIG. 1.

In the configuration shown in FIG. 8, the first fence section 128*a* is installed on generally horizontal ground, with the rail opening portions of the brackets 100 permitting the rails R to be generally horizontally positioned and the picket boards B to be generally vertically positioned, and with the picket opening portions permitting the end picket boards to be positioned with little or nor gap between the end picket boards and the posts P. The second fence section 128*b* is installed on ground that is at an angle θ from horizontal. With many known mounting brackets, a different bracket would be required for assembling this section because the rails are now angled and would not fit into the bracket opening. However, with the present bracket 100, the rail opening portions permit the rails R to be similarly angled while the picket boards B are generally vertically positioned, and with the picket opening portions permitting the end picket boards to be positioned with little or nor gap between the end picket boards and the posts P.

Due to the unique design of the bracket 100 as described herein, the identical bracket 100 (meaning another bracket with an identical construction) can be used on each end of each fence section 128*a* and 128*b*, with the bracket being rotated (for example, by 180 degrees) one way or another depending upon whether the picket board B is towards the front of the fence or towards the back. Of course, the bracket 100 can have four (or another number of) picket opening portions formed therein, so that the identical bracket need not be rotated for use on opposite ends of the rail. Also, the brackets 100 for the upper and lower rails R need not have both picket opening portions 116 and 117, but alternatively can have only one of the picket opening portions. Additionally, the bracket 100 can be beneficially utilized with other fence systems, including fences having generally linearly arranged (non-alternating) picket boards.

Accordingly, due to the slanted and flanged side walls and the rail opening portion formed thereby, the bracket can be used to erect a fence on terrain that is generally horizontal or sloped, so that only one type of bracket need be provided for a most any type of fencing installation. Additionally, due to the picket opening portions formed in the bracket side walls, the bracket can be used to erect a fence with generally uniform picket board spacing so that there are little or no visible gaps between the end pickets adjacent the upright fence posts, thereby providing privacy and security. Furthermore, a number of identical brackets can be advantageously utilized with a shadow box or other fence system to provide uniform spacing between the intermediate picket boards and between the picket boards and the upright fence posts. Of course, the bracket can be provided with the slanted and/or flanged side walls but without the picket opening portions, with the picket opening portions but without the slanted and/or flanged side walls, or with both of these features, to obtain the benefit desired in a particular application.

Having thus described the exemplary form of the present invention, those skilled in the art will additionally recognize that the within disclosures are exemplary only, and that various other alternatives, adaptations, and modifications may be made within the spirit and scope of the present invention as set forth in the following claims.

What is claimed is:

1. A bracket for use with a shadow box style fence having upright posts, rails extending laterally between the posts, and upright picket boards extending between the rails and alternating front and back, said bracket comprising:

a body having a base and a peripheral wall extending from said base and defining an opening, said peripheral wall including two opposing side walls;

said opening including a rail opening portion for receiving therein an end of one of the rails and at least one picket opening portion extending through one of said side walls for receiving therein an edge of one of the pickets and allowing the picket to extend through said side wall so that little or no visible gap is formed between the picket and the post, wherein said picket opening portion is positioned off-center of said rail opening portion so that the picket received in said off-center picket opening portion can be a front or back one; and said base adapted for mounting said body to one of the posts.

2. The bracket of claim 1 wherein said opening comprises two picket opening portions each extending through one of said opposing side walls for receiving therein an edge of one of the pickets and allowing the picket to extend all the way through said bracket on opposite sides so that little or no visible gap is formed between the picket and the post, and further comprising two opposing end walls that cooperate with said two opposing side walls to form said opening, wherein the pickets can extend through said two picket opening portions to restrain the pickets from lateral movement, said end walls can restrain the rail from lateral movement, and said bracket can be oriented and positioned at one end of the rail so that one of said side walls supports the rail or reoriented 180 degrees and positioned at the other end of the same rail so that the other one of said side walls supports the rail and the off-center picket opening portion still receives either the front picket or the back one.

3. The bracket of claim 2 wherein said picket opening portions communicate with said rail opening portion so that said opening is generally T-shaped when viewed from the front.

4. The bracket of claim 1 wherein said peripheral wall includes a distal portion spaced apart from said base, and said rail opening portion is wider at said base than at said distal portion so that the rail end can be received in said rail opening portion of said bracket when the rail is positioned perpendicularly or at another angle relative to the post.

5. The bracket of claim 4 wherein at least two of said opposing side walls are slanted towards each other.

6. The bracket of claim 5 wherein said rail opening portion is generally trapezoidal when viewed from the side.

7. The bracket of claim 4 wherein said distal portion includes an inward flange that defines said rail opening portion, and said picket opening portions extend through said flange.

8. A bracket for use with a fence having upright posts, rails extending laterally between the posts, and upright picket boards extending between the rails, said bracket comprising:

a body having a base and a peripheral wall extending from said base, said peripheral wall including two opposing side walls, said side walls having a distal portion spaced apart from said base, said side walls defining an opening that includes a rail opening portion defined by said distal portion and at least two picket opening portions extending through said side walls;

said rail opening portion adapted for receiving therein an end of one of the rails, said rail opening portion wider at said base than at said distal portion, said at least two opposing side walls slanted towards each other so that said rail opening portion is generally trapezoidal when viewed from the side, said distal portion including an inward flange, wherein the rail end can be received in said rail opening portion when the rail is positioned perpendicularly or at another angle relative to the post;

said picket opening portions extending through said opposing side walls with said picket opening portions in communication with said rail opening portion so that said opening is generally T-shaped, wherein an edge of one of the pickets can be received in the picket opening portions and allowed to extend through said side wall so that little or no visible gap is formed between the picket and the post;

said base adapted for mounting said body to one of the posts;

wherein said bracket is for use with a shadow box style fence having upright picket boards alternating front and back, wherein said picket opening portions are positioned off-center of said rail opening portion so that the picket received in said off-center picket opening portion can be a front or back one;

wherein said bracket further comprises two opposing end walls that cooperate with said two opposing side walls to form said opening, wherein said end walls restrain the rail from lateral movement and said bracket can be oriented so that one of said side walls supports the rail or reoriented 180 degrees so that the other one of said side walls supports the rail, and wherein said picket opening portions extend through said flange.

9. The bracket of claim 8 wherein said rail opening portion is generally rectangular and said at least two picket opening portions are generally rectangular.

10. The bracket of claim 8 wherein said rail opening portion is about twice as wide as said picket opening portions.

11. The bracket of claim 8 wherein said body includes at least one attachment ear extending therefrom with at least one hole defined therein for receiving at least one fastener for securing said body to said post.

12. The bracket of claim 8 wherein said bracket body is made of plastic.

13. A bracket for use with a fence having upright posts, rails extending laterally between the posts, and upright picket boards extending between the rails, said bracket comprising:

a body having a base and a peripheral wall extending from said base and defining an opening, said peripheral wall including two opposing side walls, and two opposing end walls that cooperate with said two opposing side walls to form said opening, wherein said end walls restrain the rail from lateral movement and said bracket can be oriented so that one of said side walls supports the rail or reoriented 180 degrees so that the other one of said side walls supports the rail;

said opening including a rail opening portion for receiving therein an end of one of the rails and at least two off-centered picket opening portions extending through said opposing side walls for receiving therein an edge of one of the pickets and allowing the picket to extend all the way through both of said side walls; and said base adapted for mounting said body to one of the posts.

14. The bracket of claim 13 wherein said rail opening portion is wider at said base than at said distal portion so that the rail end can be received in said rail opening portion of said bracket when the rail is positioned perpendicularly or at another angle relative to the post.

* * * * *